United States Patent [19]

Valdespino

[11] 4,020,902

[45] May 3, 1977

[54] WELL POINT SYSTEM

[75] Inventor: Joseph M. Valdespino, Orlando, Fla.

[73] Assignees: R. L. Gould; Stanley Hobbs, both of Winter Park, Fla. ; part interest to each

[22] Filed: July 3, 1975

[21] Appl. No.: 593,006

[52] U.S. Cl. ..... 166/52; 61/10; 137/433; 137/513.3; 166/54; 417/279

[51] Int. Cl.[2] ..... E02B 11/00; E21B 43/00

[58] Field of Search ..... 61/10, 11, 35, 36; 137/236, 429–433, 513.3, 513.5; 166/54; 417/279

[56] References Cited

UNITED STATES PATENTS

| | | | |
|---|---|---|---|
| 748,515 | 12/1903 | McComb | 137/433 X |
| 2,164,253 | 6/1939 | Moore | 166/54 |
| 2,176,540 | 10/1939 | Moore | 166/54 X |
| 2,654,434 | 10/1953 | Culleton | 166/54 X |
| 3,117,591 | 1/1964 | Schutmaat | 137/513.5 X |
| 3,815,626 | 6/1974 | Bryant | 137/432 |
| 3,888,605 | 6/1975 | Moore | 417/279 |

*Primary Examiner*—Paul R. Gilliam
*Assistant Examiner*—David H. Corbin
*Attorney, Agent, or Firm*—Duckworth, Hobby, Orman, Allen, & Pettis

[57] ABSTRACT

A well point system is provided having automatic regulation of the flow of fluid through each riser in order to shut off an individual riser when the water level drops below the well point of that particular riser. The automatic regulation of the flow of water is controlled above the surface of the earth and includes a float actuated valve for preventing the pump from drawing air. The float actuated valve has a controlled air bleed for evacuating the riser and allowing the water to unseat the valve when the water rises around the well point.

9 Claims, 4 Drawing Figures

WELL POINT SYSTEM

BACKGROUND OF THE INVENTION

The present invention is related to well point systems and especially to the automatic regulation of the flow of water in a well point system.

It is necessary to dewater a construction area when construction work is being done below the ground surface in order to remove all water and other liquids from an excavation area to provide dry working conditions. The most common technique of dewatering an excavation area is to sink a plurality of well points around the area and connect a pump to each of the well points so that the water will be pumped from the area surrounding the excavation. This dewatering method has proven quite satisfactory but does present certain problems. As the well points lower the water table or level, the upper portion of the well points tend to draw through to the system which seriously effects the operation of the pumps. This problem is reduced to some degree by elaborate valving devices and large vacuum pumps but the present practice still requires a manual closing of tuning valves on a well point header system. This is an especially troublesome problem where the different well points are sunk to different depths surrounding the excavation. In a typical condition with a series of well points evenly spaced and evenly located at the same depths, some of them will have evacuated their immediate area of water while an adjacent well point may not have completely evacuated the water depending upon the soil structure and the liquid yield of the soil. The well points drawing air must be isolated from the header manifolds so that a pumping machine is not allowed to draw the air. Since each point cannot be constantly monitored, a means for eliminating free air entry from a centrifugal pump had to be devised and a vacuum pump was implemented in combination with the pump as an essential part of the rig. Even so, without the practice of manual tuning, the air handling capacity of a well point pump is frequently overcome.

In order to overcome these problems, several automatic tuning systems for well pump systems have been devised including U.S. Pat. No. 3,815,626 for an apparatus for the automatic regulation of the flow of fluid in which the well pump has incorporated therein automatic regulation for the flow of water which operates on a rising and falling float in response to the water levels surrounding the well point. In addition, three U.S. Pat. to T. F. Moore, Nos. 2,176,540; 2,164,253 and 2,474,364 are directed towards well point systems and to the improvement of well point systems by use of automatic tuning well points. These well points work on floats located in the well point responsive to the level of ground water which actuates the float to block the flow of air when the water level drops below a predetermined level. These prior art automatic tuning well points are, however, located in the well points themselves which then must be drilled deep into the earth, thereby substantially increasing the costs of an individual well point which frequently must be left in the earth and increasing the size and complexity of the well point. By increasing the complexity of the well point located deep in the earth the likelihood of failure of the well point is also increased. It is accordingly one advantage of the present invention that an automatic tuning valve for well points may be located above the earth in the riser between the well point and the manifold to shut off a particular riser and well point when the well point starts drawing air.

One prior U.S. Pat. No. 2,654,434 teaches an apparatus for drying excavations by providing a float actuated valve for bleeding air in a well point system by locating a valve at the highest point and bleeding air from the manifold of the well point system.

One reason that automatic tuning valves have been located in well points rather than above the earth is because the water level is needed to actuate the float to shut off the air, and more importantly, the water level is needed to reactuate the float to turn the well point back on when the water level rises.

SUMMARY OF THE INVENTION

The present invention provides a well point system including a well point pump connected to a manifold, which in turn is connected to a plurality of riser pipes leading into the earth and to well points. A self-tuning well point valve is located above the earth in each riser for turning each well point on and off responsive to the flow of water through the riser. The selftuning valve has a casing with a passageway therethrough with a float located in the casing, which float is lifted by the flow of liquid through the valve casing. The float is biased by a spring or weight towards a closed position which bias is easily overcome by the flow of liquid lifting the float. The valve seal or disc is located in the casing and is operatively secured to the float and moves up and down with the float responsive to the flow of liquid through the valve and moves to substantially seal the port in the valve in the absence of water passing therethrough responsive to the biasing of the float. An air bleed is provided for allowing predetermined amounts of air to escape through the port when the valve seal is seated in the valve seat thereby generating a small vacuum in the riser to reactuate the well point when the water level rises. The valve seal or disc is made of a soft material and may be locked manually to close the valve and cut off the well point and seal the air bleed. The float biasing may be by means of a spring, weight or magnet.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
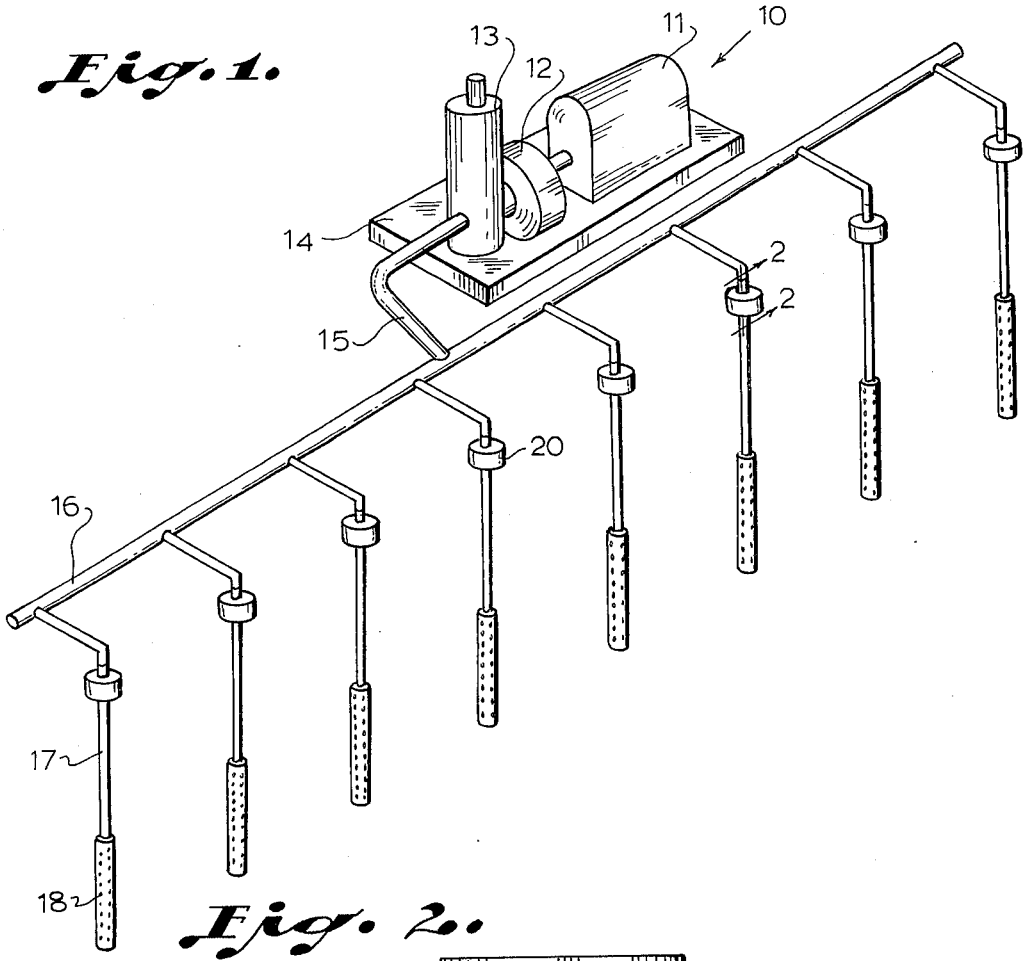
FIG. 1 illustrates a perspective view of a well point system having the automatic tuning valves located in each of the risers.

Referring to FIG. 1 of the drawings, a conventional well point system 10 is illustrated having a pumping motor 11, driving a pump 12 and a conventional priming device 13 mounted on a base 14. The priming device is connected by means of a line 15 to a well point manifold 16 which is connected to a plurality of risers 17, each riser 17 being connected to a well point 18 located below the surface of the earth. Each riser 17 has an automatic well point tuning valve 20 located in the riser.

In operation, each well point 18 is sunk to a predetermined depth surrounding an excavation and has a riser 17 connecting the well point to the manifold 16 into the pumping system for pumping water from the earth surrounding the excavation to keep the excavation area dewatered.

Figure 2:
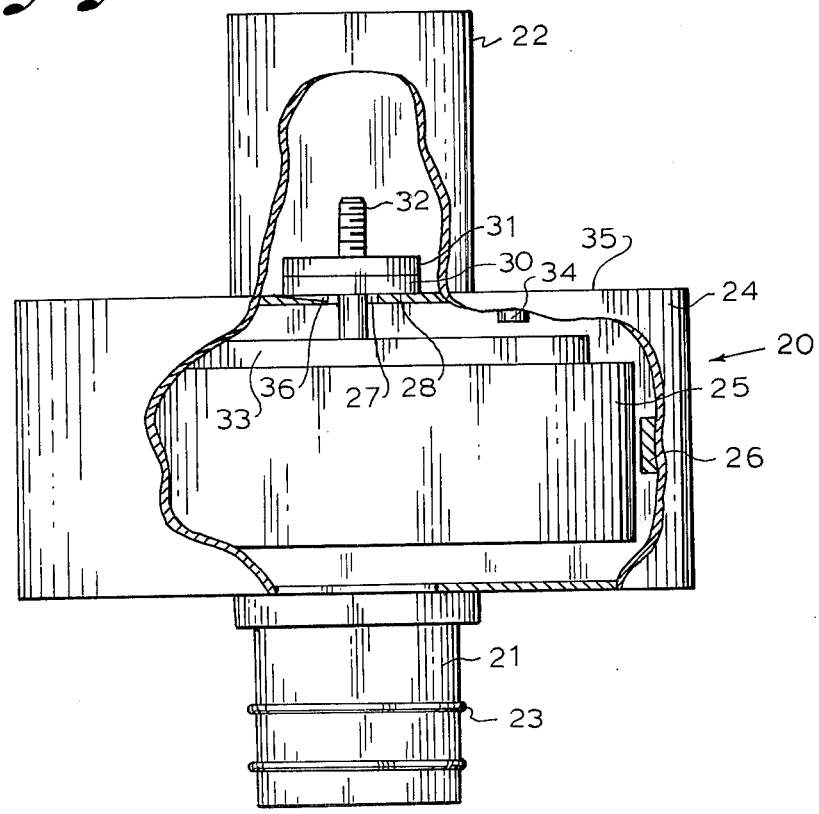
FIG. 2 is a cut-away sectional view taken along the line 2—2 of FIG. 1.

Referring now to FIG. 2, the automatic shut off valve 20 is illustrated having an input line 21 and an output line 22, the input line having a pair of sealing O-rings 23 wrapped therearound. The lines 21 and 22 are connected to the main casing 24 and form a part of the casing of the valve. The input 21 and output 22 are each connected to one side of the riser pipe 17 of FIG. 1. A float 25 is located within the casing 24 and is held in alignment with guides 26 attached to the side of the casing 24 which prevents the float 25 from shifting sides. It also allows the flow of fluid being received by the input 21 to flow around the float, through a valve port 27 and out the output 22. The valve port 27 has a valve seat 28 adjacent thereto and a soft gum rubber disc or valve seal 30. The valve seal 30 has a rigid disc backing 31 which may be threadedly attached to the valve stem 32 for adjusting the valve seal 30. The valve seal 30 is sometimes referred to as a disc or valve plug and is not limited to the particular shape of the seal but may be any shape desired. The shaft 32 is connected to the top of the float 25 and in this embodiment includes a weight 33 which may be lead, or a similar noncorrosive heavy material, attached to the top of the float 25. A float stop 34 prevents the float 25 from rising up against the top wall 35 of a casing 24 and thereby shutting off the flow of fluid therethrough. As long as a liquid such as water is flowing through the valve 20, the float 25 will be held in an open position with the seal 30 lifted from the port 27 to allow the flow of water around the float and through the port 27 and out the output 22. Thus, as long as liquid is flowing through the valve the valve will remain open and allow the continued flow of liquid responsive to the pump. However, once the particular well point connected to the riser housing a particular valve starts drawing air, the air will not support the float 25 with the weight 33 in an open position and will allow the float to drop, thereby allowing the valve seal 30 to seat itself on the valve seat 28, closing the port 27 and closing the well point off without effecting the remaining well points and the dewatering system. However, once the water level rises above the particular well point, the valve must be turned on again and this is accomplished with one or more air bleeds 36 which are formed with small grooves passing through the valve seat 28 to allow a small amount of air to escape. This air is insufficient to harm the pump yet generates sufficient vacuum in the particular riser so that when the water level rises around the well point it will activate after a short delay of lifting the water, raise the float 25, and open the valve to the flow of water. The amount of air that can be bled through the air bleed 36 is controlled by the size of the air bleed or plurality of air bleeds to allow small amounts of air sufficient to generate the necessary vacuum to pull the water up the riser but sufficiently small to prevent large amounts of air from interferring with the operation of the pump. Typically, 2–5 cubic inches per minute of air can be allowed to bleed through the valve to generate the necessary vacuum to evacuate the riser for allowing water to unseat the valve but without interferring with the operation of the pump. This air bleed, of course, may be varied for different sizes and different types of pumping systems but will work with different degrees of efficiency provided sufficient air is allowed to bleed to create sufficient vacuum to raise the water through the riser while blocking the free flow of air through the valve. Generally the limits of air that can be bled through the valve within a range from 1/10 cubic inch per minute to 10 cubic inches per minute.

It should also be clear from this embodiment that the valve disc 30 and vacuum 31 could be of a magnetic material acting in conjunction with a metallic valve seat 28 for closing the valve responsive to the magnet pull against the valve seat thereby eliminating the weight 33 and allowing for a rapid opening of the valve.

Figure 3:
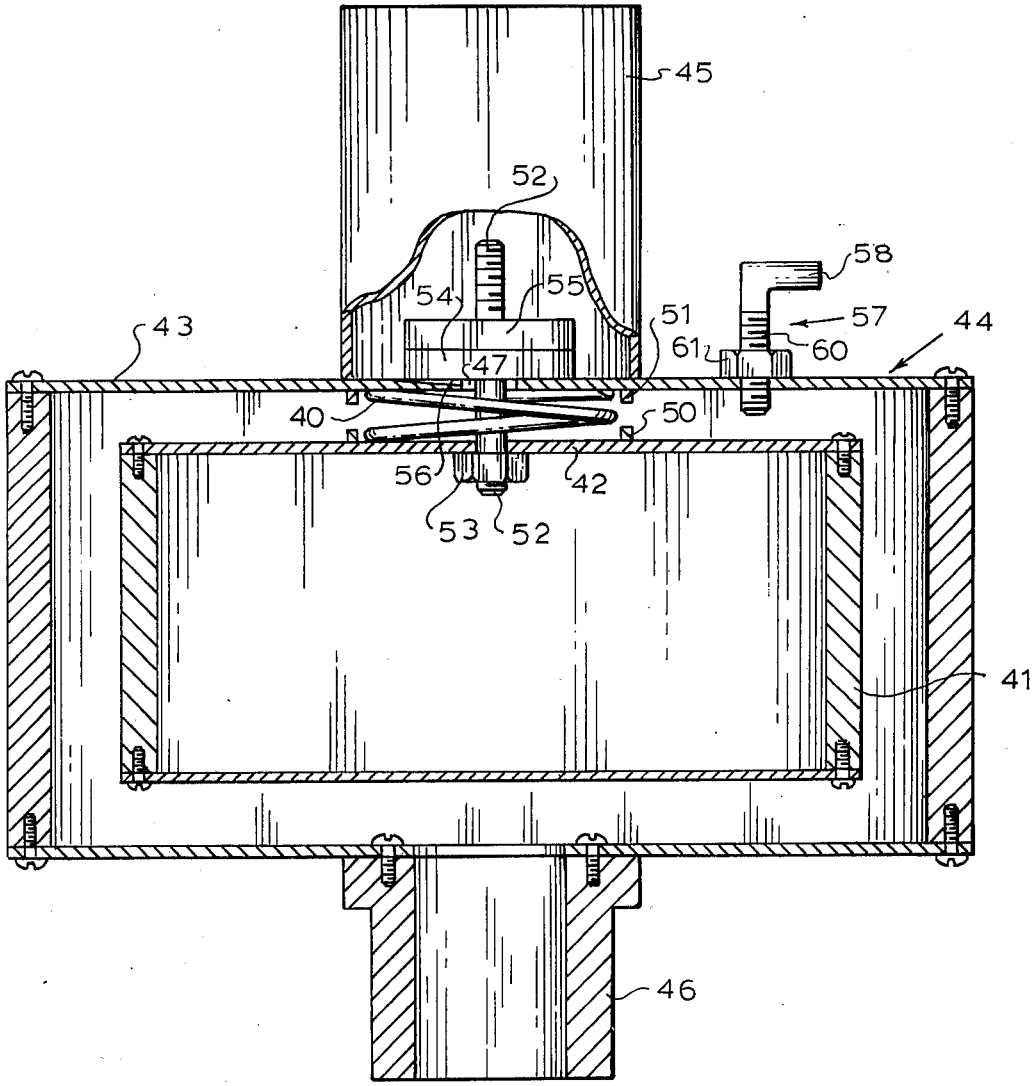
FIG. 3 is a sectional view of a second embodiment of the automatic tuning valve for a well point system.

In addition to using a weight or a magnet, FIG. 3 illustrates the use of a spring 40, the spring biasing the float 41 which spring is biased between the top 42 of the float 41 and the top 43 of the casing 44. The casing 44 has an output 45 and input 46 connected thereto and has a valve port 47 passing through the top 43. The spring 40 may be positioned with an annular ledge 50 connected to the top 42 of the float 41 and an annular ledge 51 connected to the top 43 of the casing 44. The spring can be made of any material desired but should be a noncorrosive material and must be chosen of the correct compressible forces to produce the necessary bias for closing the valve in the absence of water but allowing the water lifting the float 41 to open the valve. The spring is also held in place by the valve stem 52 which is threaded at each end and has a nut 53 located inside the float 41 for holding the stem at one end and has the valve seal or disc 54 with a rigid backing 55 threaded onto the stem 52, located on the other side of the port 47, above the top 43 of the casing 44. This embodiment has an air bleed 56 cut into the top 43, passing under the seal 54 of the valve. In addition, the present embodiment has a valve locking member 57 having a handle 58 and thread portion 60, three nuts 61 and through the top 43 of the casing 44. By rotating the handle 58 the thread member 60 is driven through the nut 61 and against the top 42 of the float 41 to force the float downward to force the valve disc 54 onto the valve seat, closing the port 47. The valve seal may be made of a soft gum rubber which in normal operation would allow the closed valve to allow the bleed 56 to bleed predetermined amounts of air but under the stronger mechanical force to the stop member 57 being threaded against the float 41, the valve seal 54 can be forced to close the bleed 56 thereby completely closing the valve and shutting off a particular riser manually.

Figure 4:
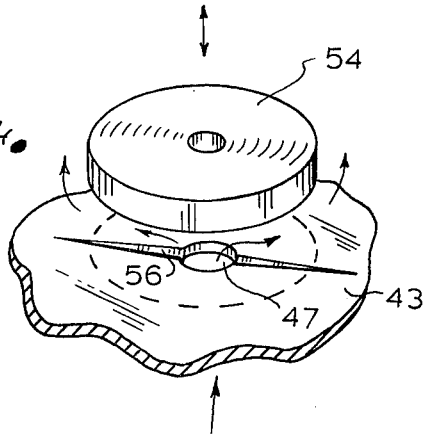
FIG. 4 is a perspective view of the tuning valve disc and seat.

FIG. 4 more clearly illustrates the air bleeds 56 in the casing top 43 to bypass the valve seal 54 from the valve port 47.

It should be clear at this point that a well point system having automatic tuning valves for the automatic regulation of the flow of water through the well point risers has been provided. The typical valve can be made having a plastic or polymer casing along with noncorrosive componenets throughout. This invention, however, is not to be construed as limited to the particular forms disclosed herein since these are to be regarded as illustrative rather than restrictive.

I claim:

1. A well point system comprising in combination:

a pumping means;

a plurality of well points;

a plurality of risers attached to said well points and operatively coupled to said pump means for connecting each said well point to said pumping means;

a plurality of valves each being coupled to a riser for substantially cutting off individual risers in the absence of the flow of water, each said valve having a casing with an input portion connected to the well point side of a riser and an output portion connected to the pump side of a riser, said valve having a float located in said casing in said input portion with said float being lifted in said casing by a liquid therein, and said valve also having a float biasing means operatively connected to said float for biasing said float in one direction and a valve port sealing means located in said casing in said output portion thereof being operatively secured to said float and movable therewith to substantially seal said port in said casing in the absence of liquid in said casing in the absence of liquid in said casing responsive to said float biasing means; and air bleed means located adjacent said valve port for allowing air to escape past said sealing means once said valve sealing means is closed, whereby said air passage prevents complete sealing of said valve port to allow rising liquid to unseal the valve sealing means.

2. The apparatus in accordance with claim 1 in which said casing has float guides therein for maintaining said float in a predetermined position as it rises or falls responsive to the flow of liquids.

3. The apparatus in accordance with claim 1 in which said valve has a float lock for locking said float in a position to close said sealing means and valve port to the flow of liquid therethrough.

4. The apparatus in accordance with claim 1 in which said float biasing means includes a spring biasing said float away from a portion of said casing.

5. The apparatus in accordance with claim 1 in which said biasing means includes a mass located to increase the gravitational pull of said float.

6. The apparatus in accordance with claim 5 in which said air bleed includes a plurality of small grooved passageways in the valve seat adjacent said valve port.

7. The apparatus in accordance with claim 1 in which said air bleed means includes air bleeds of predetermined size for bleeding predetermined amounts of air therethrough.

8. The apparatus in accordance with claim 6 in which the air bleeds are sized to allow air between the limits of one-half cubic foot and ten cubic feet per minute to pass therethrough.

9. The apparatus in accordance with claim 1 in which a float stop means is attached to said casing adjacent said valve port for preventing said float from blocking said valve port when said float is lifted by the flow of liquid.

* * * * *